US009080825B2

(12) United States Patent
Tusting

(10) Patent No.: US 9,080,825 B2
(45) Date of Patent: Jul. 14, 2015

(54) RATCHETING MECHANISM FOR A REVOLVER

(71) Applicant: Paul A. Tusting, Salt Lake City, UT (US)

(72) Inventor: Paul A. Tusting, Salt Lake City, UT (US)

( * ) Notice: Subject to any disclaimer, the term of this patent is extended or adjusted under 35 U.S.C. 154(b) by 0 days.

(21) Appl. No.: 14/471,901

(22) Filed: Aug. 28, 2014

(65) Prior Publication Data

US 2015/0047243 A1 Feb. 19, 2015

Related U.S. Application Data

(63) Continuation-in-part of application No. 13/968,179, filed on Aug. 15, 2013, now Pat. No. 8,844,184.

(51) Int. Cl.

| | |
|---|---|
| ***F41A 17/00*** | (2006.01) |
| ***F41C 3/14*** | (2006.01) |
| ***F41A 19/52*** | (2006.01) |
| *F41C 33/04* | (2006.01) |

(52) U.S. Cl.

CPC ..... *F41A 19/52* (2013.01); *F41A 17/00* (2013.01); *F41C 3/14* (2013.01); *F41C 33/048* (2013.01)

(58) Field of Classification Search

USPC ..... 42/59, 65, 67, 62, 61, 63, 66

See application file for complete search history.

(56) References Cited

U.S. PATENT DOCUMENTS

| | | | | | |
|---|---|---|---|---|---|
| 12,555 | A | * | 3/1855 | Newbury | 42/61 |
| 117,461 | A | | 7/1871 | Richards | |
| 250,375 | A | | 12/1881 | Mason | |
| 263,551 | A | * | 8/1882 | Mason | 42/65 |
| 311,383 | A | * | 1/1885 | Smith | 42/65 |
| 380,361 | A | * | 4/1888 | Sprague | 42/62 |
| 565,245 | A | * | 8/1896 | Baker | 42/62 |
| 627,966 | A | | 7/1899 | Behr | |
| 630,478 | A | | 8/1899 | Behr | |
| 631,951 | A | * | 8/1899 | Chandler | 42/65 |
| 778,500 | A | * | 12/1904 | Mossberg | 42/65 |
| 933,188 | A | * | 9/1909 | Leggett | 42/66 |
| 955,436 | A | * | 4/1910 | Reid | 42/65 |

(Continued)

FOREIGN PATENT DOCUMENTS

GB 11998 0/1898

OTHER PUBLICATIONS

'58 Remington Conversion Cylinders for Pietta or Uberti made Revolvers, KIRST Konverter LLC, www.kirstkonverter.com/1858-remington.html.

(Continued)

*Primary Examiner* — Reginald Tillman, Jr.

(74) *Attorney, Agent, or Firm* — Geoffrey E. Dobbin; Dobbin IP Law P.C.

(57) ABSTRACT

A firearm utilizing a ratcheting system to rotate a cylinder containing ammunition is disclosed. The ratchet system is designed to accommodate the cylinder being in an initial safe (without a chamber centered over the barrel and hammer) and subsequent active positions. A ratchet arm protrudes through the breach plate and is supported thereon as it pushes ratchet pads on the cylinder from a starting point in either position to the next active position. Numerous designs for the ratchet pads and the ratchet arm are disclosed, as is a stepped drawbar to accommodate the workings of the firearm and a locking bar that interfaces with both the hammer and locking notches in the circumference of the cylinder so as to release and secure the cylinder in appropriate positions.

17 Claims, 19 Drawing Sheets

(56) References Cited

U.S. PATENT DOCUMENTS

| | | | | | |
|---|---|---|---|---|---|
| 3,158,948 | A | * | 12/1964 | Freed | 42/65 |
| 3,163,951 | A | * | 1/1965 | Lewis | 42/65 |
| 3,237,336 | A | * | 3/1966 | Lewis | 42/59 |
| 3,381,404 | A | * | 5/1968 | Quinn | 42/59 |
| 3,651,593 | A | * | 3/1972 | Clark | 42/65 |
| 3,654,720 | A | * | 4/1972 | Ruger | 42/75.01 |
| 3,711,982 | A | * | 1/1973 | Baker | 42/62 |
| 4,307,530 | A | * | 12/1981 | Melcher et al. | 42/67 |
| 4,651,456 | A | * | 3/1987 | Ghisoni | 42/62 |
| 4,694,602 | A | | 9/1987 | Pust | |
| 5,974,941 | A | | 11/1999 | Kushnir et al. | |
| 6,385,888 | B1 | | 5/2002 | Power | |
| 7,523,578 | B2 | | 4/2009 | Ghisoni | |

OTHER PUBLICATIONS

1858 New Army .45 Uberti, Howell Old West Conversions LLC, http://www.howelloldwestconversions.com/shop/productinfo.cfm?catID=261&productid=818&cfid=2724164&cftoken=7151c0a5825a265c-9BBF6F26-EF93-94D4-001CF7C0BE8861DA.

1860 .45 Colt/Schofield, Howell Old West Conversions LLC, http://www.howelloldwestconversions.com/shop/productinfo.cfm?catID=261&productid=806&cfid=2724164&cftoken=7151c0a5825a265c-9BBF6F26-EF93-94D4-001CF7C0BE8861DA.

* cited by examiner

RATCHETING MECHANISM FOR A REVOLVER

CROSS-REFERENCES TO RELATED APPLICATIONS

This Application claims priority as a continuation-in-part of prior filed U.S. Non-provisional application Ser. No. 13/968,179 filed Aug. 15, 2013 which in turn claims priority on prior filed U.S. Provisional application No. 61/691,229, filed Aug. 20, 2012 and incorporates both of these applications herein by reference in their entirety.

FIELD OF THE INVENTION

The present invention relates to the field of firearms and more particularly relates to a ratcheting mechanism for the advancement of a revolver's cylinder.

BACKGROUND OF THE INVENTION

Personal defense is a matter of choice for individuals. Some choose to not have any, others prefer training in martial arts, some choose a weapon. Often times, that weapon is a firearm such as a small handgun, so the use of a firearm for personal defense is well known. Users of firearms tend to conceal them in their clothing or other objects. Law enforcement and military personnel often conceal them on their persons as a "back-up" weapon, in case their primary weapon fails or situations become dire. As such, the ideal back-up weapon is ideally small and easily concealable. Their positioning is not to hinder the movement of the carrier. They tend to carry a few rounds of ammunition and maybe have some container or magazine to carry spare rounds. They tend not to be very accurate at a distance.

In conjunction with the development of multi-cartridge magazines, the revolver was one of the greatest advancements in firearm technology in the nineteenth century. With either of these systems, a weapon could be loaded at one convenient time and store multiple shots of ammunition for when they were needed. The revolver became the "go-to" personal weapon of the western US territories as they we easily carried on the person, easily used, and carried a number of cartridges for multiple firings.

The traditional revolver may be either single or double action mechanism with a hammer or striker located rearward of an ammunition storing cylinder. When firing, the hammer is released and it impinges a firing pin, which in turn impinges the ammunition cartridge, firing it. Before firing again, the cylinder must rotate to position the next cartridge. The most common method of rotating the cylinder is a ratchet mechanism. The most common ratchet mechanisms are typically keyed to either the trigger or the hammer. Double action revolvers are keyed to the trigger so that as the trigger is pulled, a ratchet arm pushes the cylinder so that it rotates and positions the next occupied chamber for firing. As the trigger returns to its ready-to-fire position, it draws the ratchet arm down and resets it for the next firing. Single action revolvers are typically keyed to the hammer. In order for either system to work, then, a ratchet gear or ratchet pad must be positioned on the cylinder.

When designing a smaller revolver, such as one to serve as a back-up personal defense weapon, the size of the cylinder and the associated weapon become a limiting factor. Any ratchet system must be durable enough to withstand repeated use but yet be effective. Unfortunately, as the cylinder becomes smaller, it becomes more and more difficult to position a ratchet pad on the cylinder.

The present invention is a compact ratcheting system for such a revolver that utilizes an otherwise freely movable ratchet arm that is arrested in its forward motion by the structure of the firearm itself so as to prevent excessive contact of the ratchet arm with the cylinder or binding on the cartridges contained in the cylinder chambers.

The present invention represents a departure from the prior art in that the firearm of the present invention allows for a ratcheting mechanism coupled with a small-scale design suitable for a personal back-up weapon.

SUMMARY OF THE INVENTION

In view of the foregoing disadvantages inherent in the known types of firearms, this invention provides a ratchet system for a smaller revolver. As such, the present invention's general purpose is to provide a new and improved back-up revolver that is easily concealed, readily drawn and reliably deployed.

To accomplish these objectives, the firearm comprises ratchet mechanism that is sufficiently small for use in a small revolver. However, as the design for a smaller system is made, care must be taken for the ratchet arm to not over engage the cylinder or cartridges. The drawbar of the firearm must also be redesigned to fit the system and the timing of the cylinder rotation mechanism must be precise in order to prevent binding of the system—all difficulties inherent in reducing the size of a ratchet system as a whole.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

Figure 1:
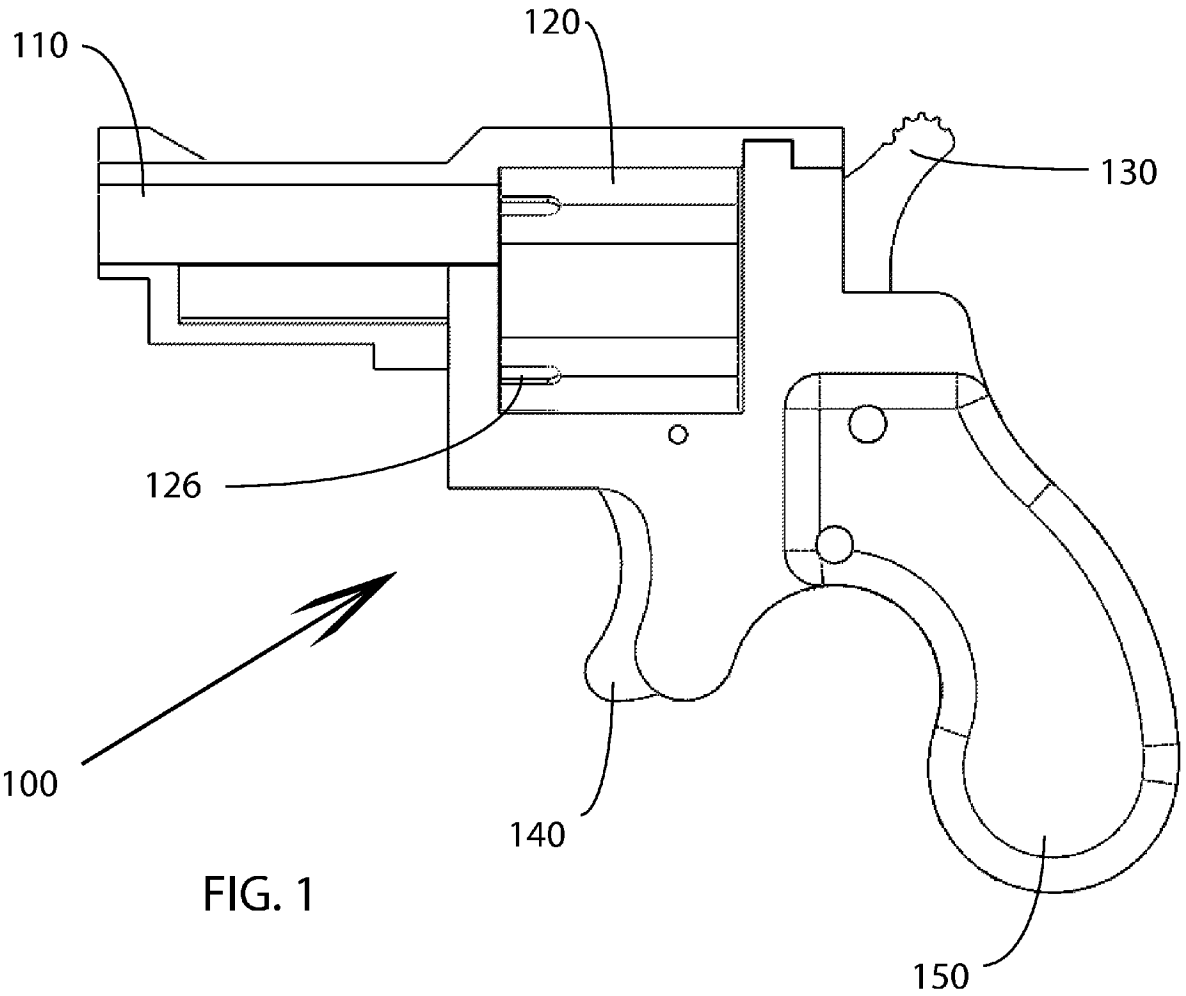
FIG. 1 is a side elevation of one embodiment of a revolver.
Figure 2:
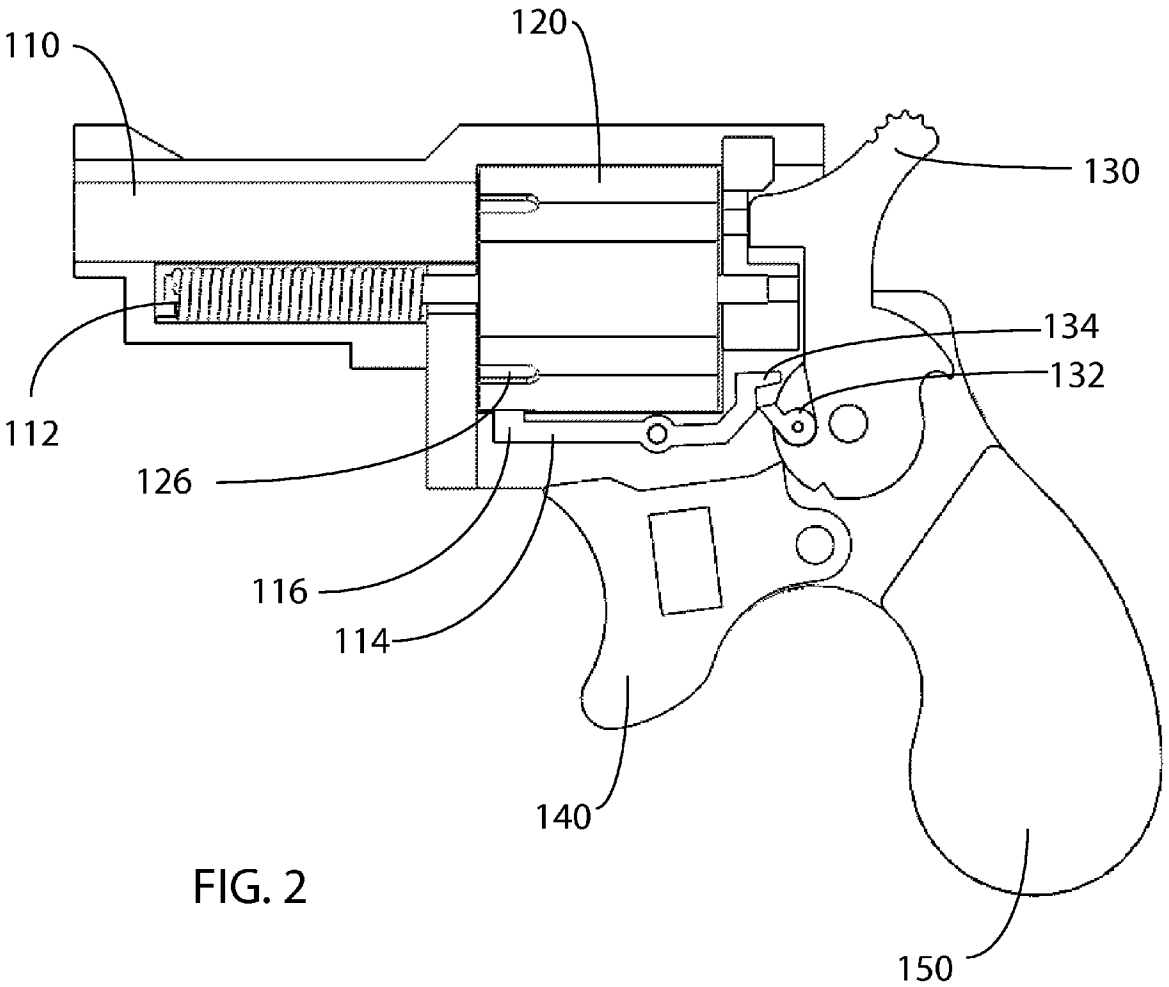
FIG. 2 is a sectional view of the revolver of FIG. 1 in a stowed orientation.
Figure 3:
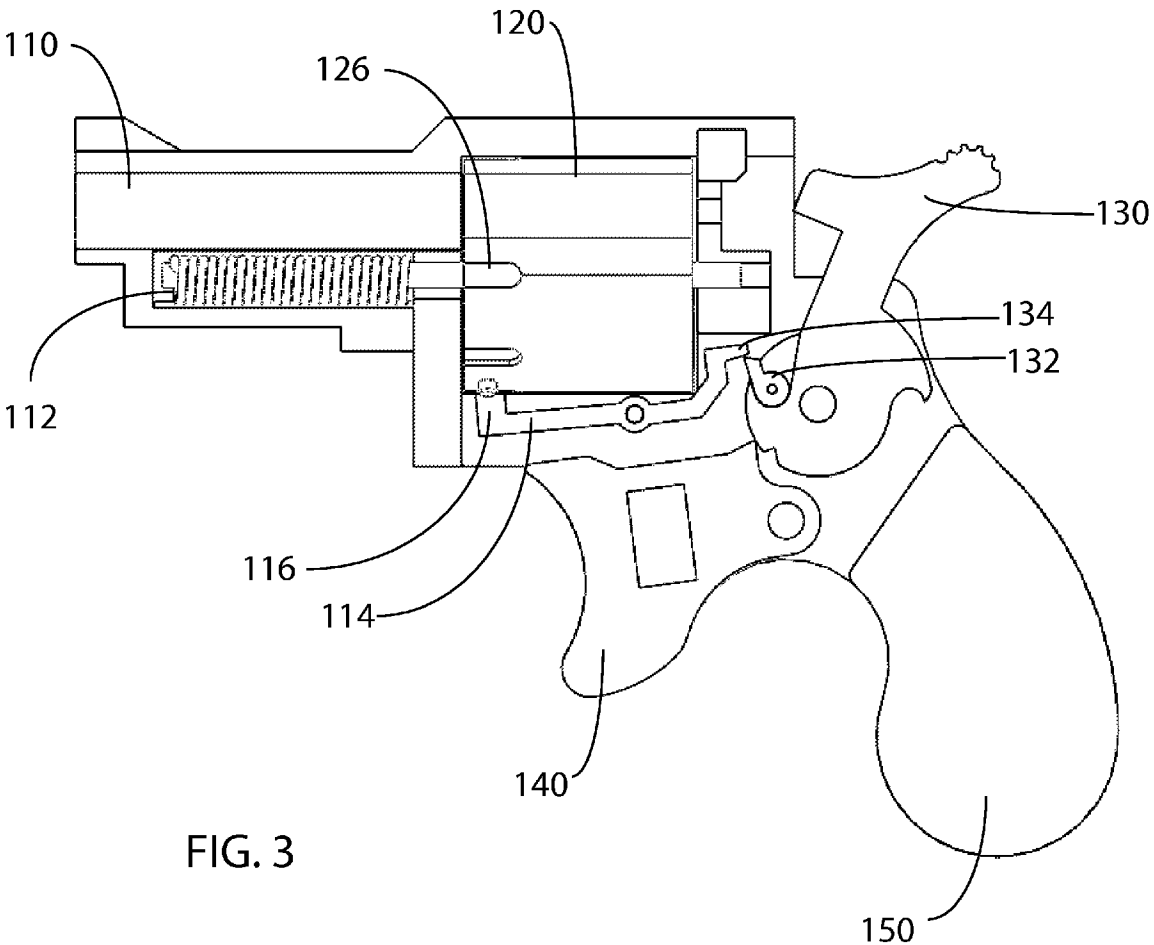
FIG. 3 is a sectional view of the revolver of FIG. 1, in the process of cocking.
Figure 4:
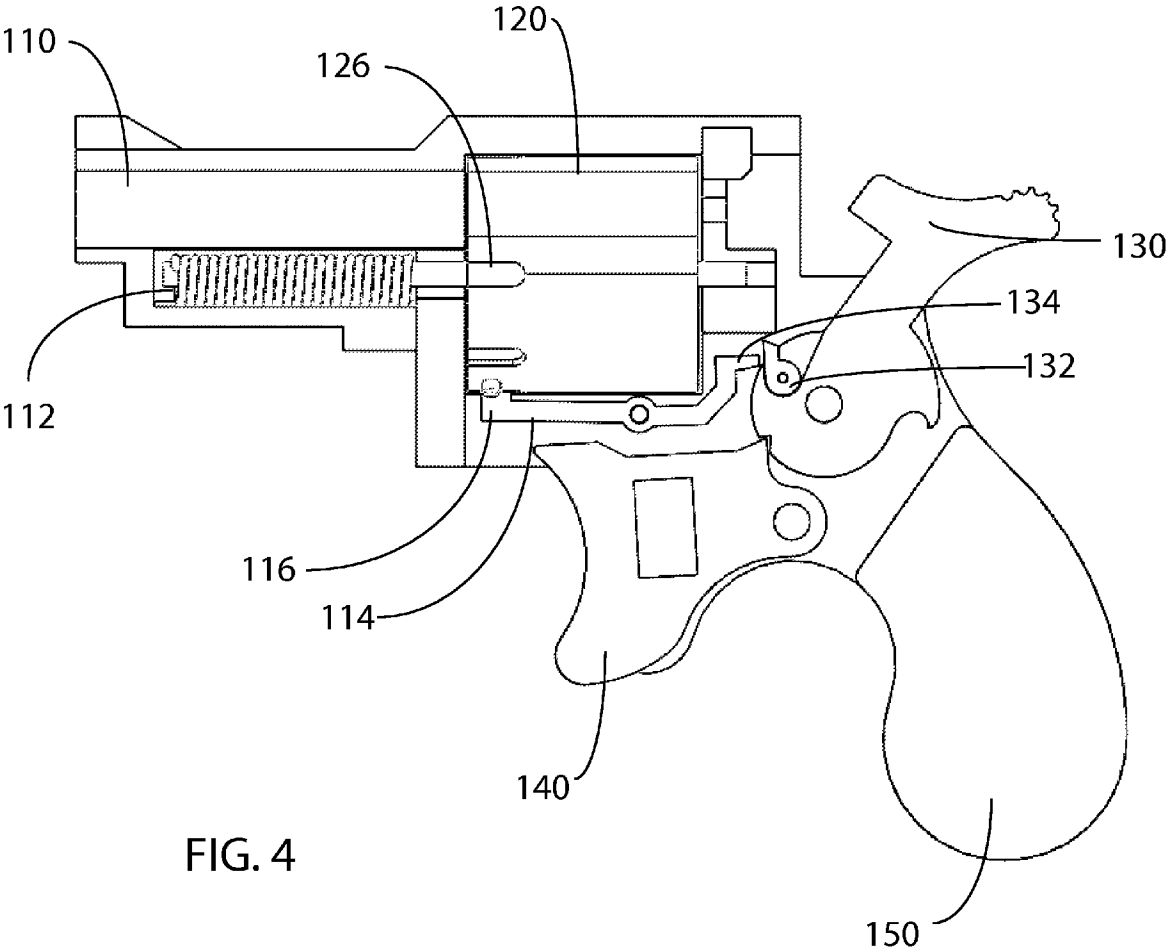
FIG. 4 is a sectional view of the revolver of FIG. 1, fully cocked.
Figure 5:
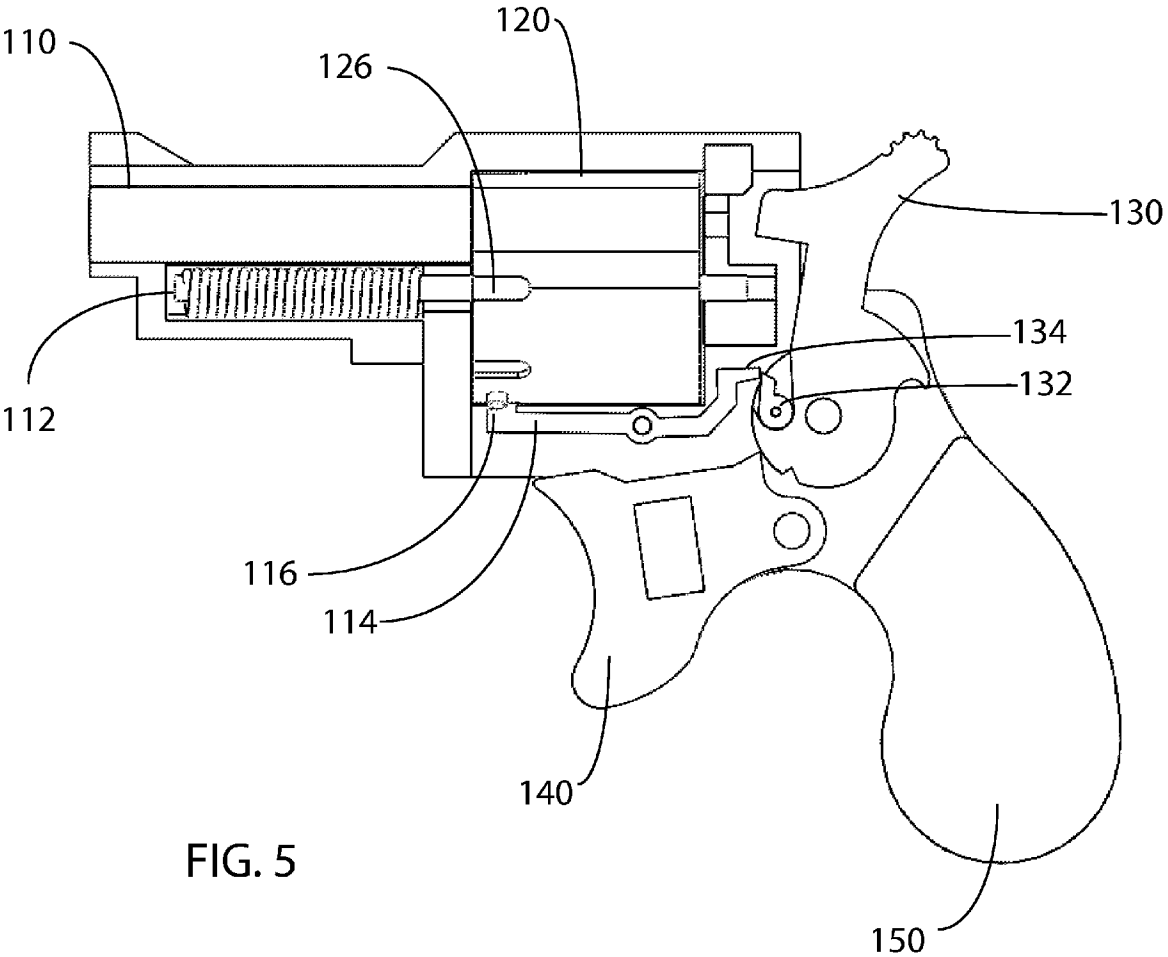
FIG. 5 is a sectional view of the revolver of FIG. 1, firing.

With reference now to the drawings, the preferred embodiment of the firearm is herein described. It should be noted that the articles "a", "an", and "the", as used in this specification, include plural referents unless the content clearly dictates otherwise. Reference numerals indicated in the specification are consistent through all drawing sheets and indicate the following items:

100—a revolver embodying the primary aspects of the parent invention;

110—original barrel;

112—original cylinder spring;

114—original cylinder locking bar;

116—original locking bar key;

120—original revolver cylinder;

126—original cylinder position lock grooves;

130—original hammer;

132—original hammer pawl;

134—original locking bar plate;

140—original trigger;

150—original handgrip;

200—a revolver embodying the primary aspects described in the present application;

202—barrel;

204—exemplary cartridge;

206—chamber;

210—trigger;

220—drawbar;

230—hammer;

232—hammer pawl;

235—sear groove;

240—locking bar;

242—locking bar plate;

244—locking bar key;

250—ratchet arm;

251—alternate ratchet arm with two hands;

252—ratchet arm pivot bore;

253—alternate ratchet arm with two shoulders;

254—ratchet arm hand;

255—alternate ratchet arm with roller;

256—ratchet arm shoulder

257—roller;

259—ratchet arm embodiment linked to alternate hammer;

260—cylinder;

262—active locking notches;

263—individual ratchet pads;

264—safety notch;

265—removable ratchet pad;

266—ratchet pad;
267—shaft;
268—flat side of shaft;
269—alternate hammer with ratchet arm;
270—breach plate;
272—breach plate slot;
274—breach plate trough;
276—breach plate spur.

With reference to FIG. 1, an exemplary revolver 100 has the main components expected of a revolver, that is to say it has a barrel 110, cylinder 120, hammer 130, trigger 140 and grip 150 all mounted upon a frame or receiver. Its internal workings, however, shown in FIGS. 2-5, however, reveal a different sort of weapon. First, the cylinder 120 is powered by a torsion-type cylinder spring 112 mounted beneath the barrel 110. A pivoting locking bar 114 maintains the cylinder 120 against the spring pressure. The forward end of the locking bar 114 is a locking bar key 116 designed to interface with specifically positioned lock grooves 126 on a forward end of the cylinder 120. The end opposite the key features a locking bar plate 134 which interfaces with a pawl 132 pivotably mounted upon the hammer 130.

Figure 6:
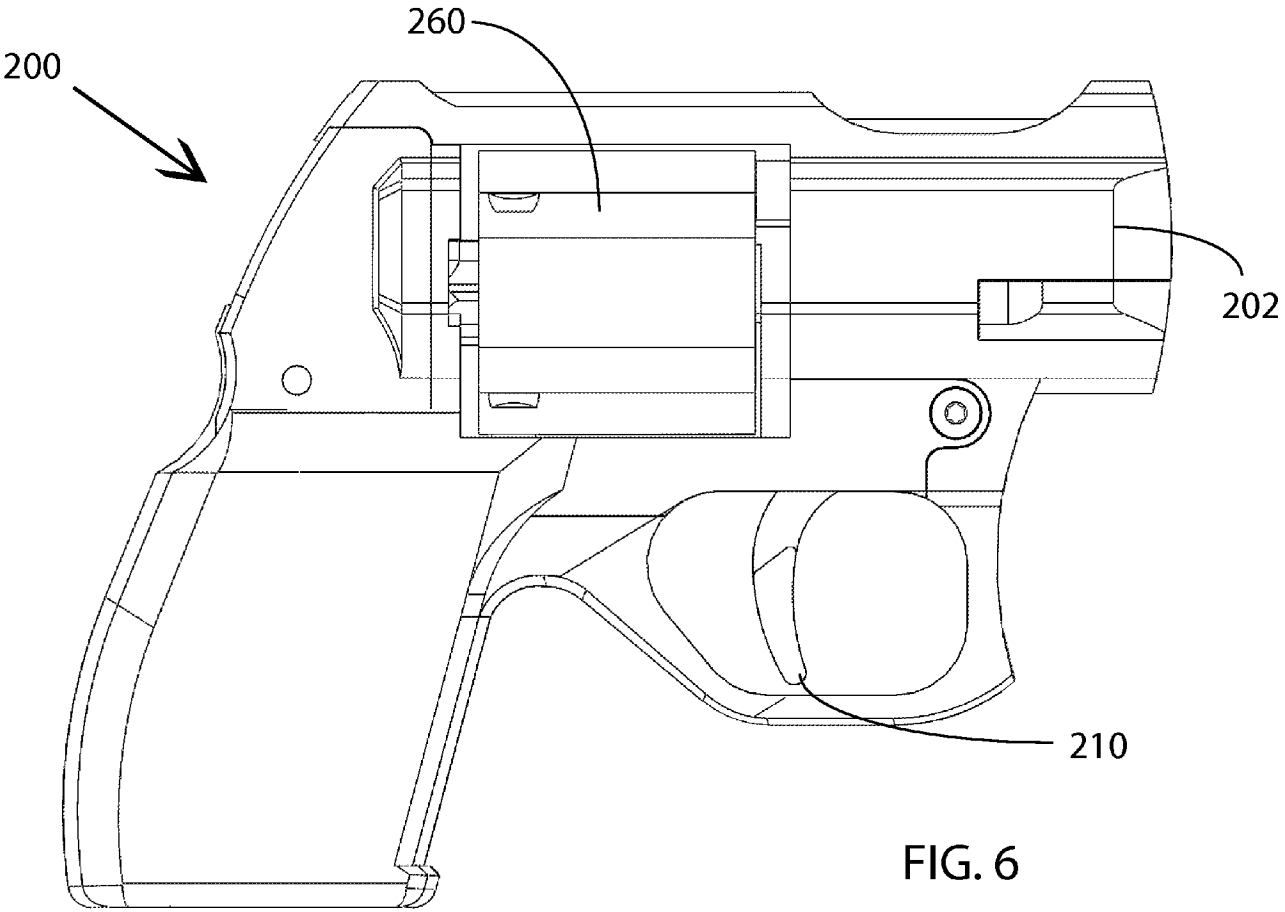
FIG. 6 is a side elevation view of one embodiment of a revolver according to the present invention.
Figure 7:
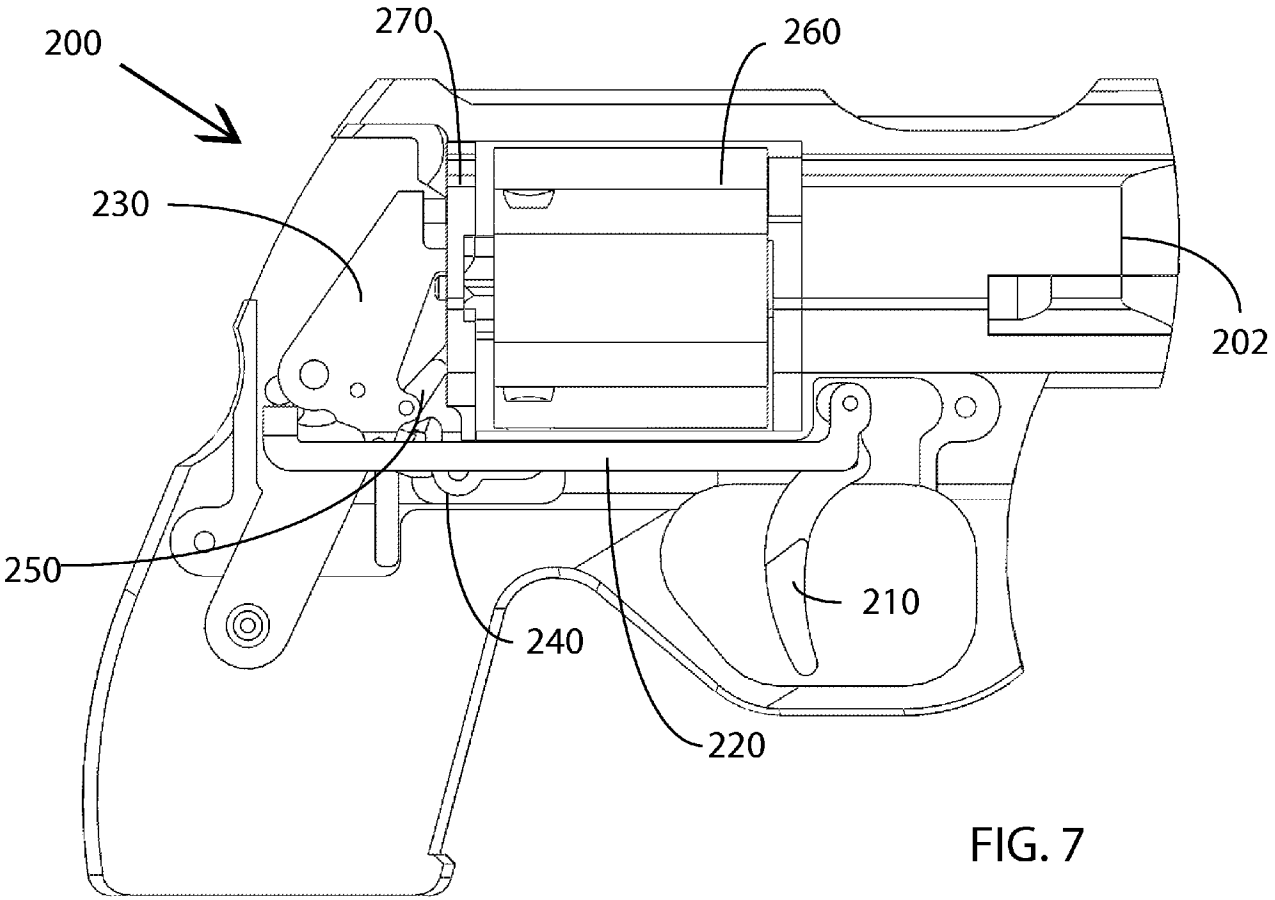
FIG. 7 is side elevation view of the revolver of FIG. 6, with a side plate and grip removed to display the internal mechanism of the revolver.

In an alternate embodiment 200, shown in the figures starting with FIG. 6, a ratchet is used to rotate the cylinder. Given the complexity of a ratchet embodiment, numerous adjustments need be made to accommodate a working ratchet in such a small space as is afforded by the intended weapon design specifications. Of particular note, in FIG. 7, trigger 210 is directly connected to a drawbar 220 such that drawbar 220 is pulled forward when trigger 210 is actuated. Hammer 230 has a sear groove 235 which interacts with the drawbar 220 and is pivoted so that forward motion of the drawbar 220 rotates the hammer 230 backward until the sear groove 235 disengages from the drawbar 220, releasing the hammer 230 to strike the ammunition (not shown). The hammer 230, in turn, actuates the ratchet arm 250 and locking bar 240, enabling the rotation of the cylinder 260.

Figure 9:
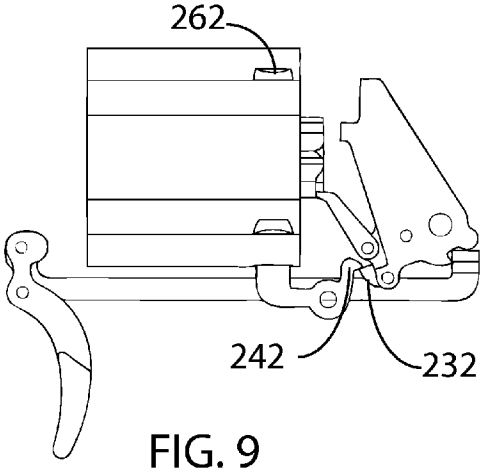
FIG. 9 is a side elevation view of the mechanism utilized in the revolver of FIG. 6, with the hammer pawl contacting the locking bar plate.
Figure 8:
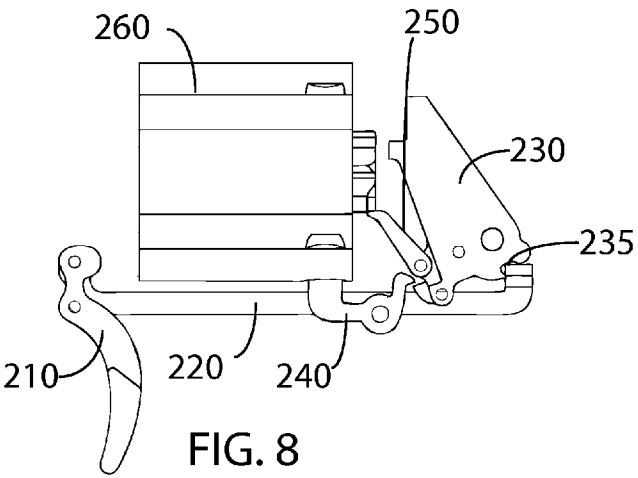
FIG. 8 is a side elevation view of the mechanism utilized in the revolver of FIG. 6, in a stowed position.
Figure 10:
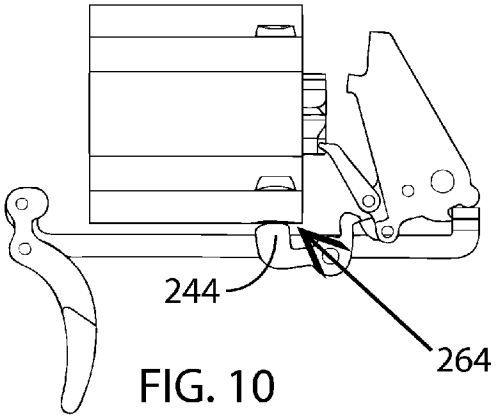
FIG. 10 is a side elevation view of the mechanism utilized in the revolver of FIG. 6, with the locking bar key disengaging from the cylinder safety lock groove.

An initial firing cycle is depicted successively in FIGS. 8-17. In FIG. 8, the firearm is in a stowed position. Specifically, cylinder 260 is rotated such that no chamber 206 is centered under the hammer 230 (FIGS. 7 and 18) of the weapon. Unless the barrel is integrated with the chamber (such as a pepperbox design) no chamber will likewise be over the barrel 202 (FIG. 6). It is to be understood for purposes of this application and the appended claims that the term "barrel" includes those structures where a cylinder chamber serves as a barrel. In either event, the cylinder 260 has a series of locking notches 262 around its circumference with which the locking bar 240 interfaces. At least one safety position is achieved by a notch 264 centered between two notches 262 corresponding to a ready to fire paradigm. As the trigger 210 is pulled, it pulls on the drawbar 220 which rotates the hammer 230 (FIG. 9). The hammer features a pawl 232 which initially contacts a plate 242 of the locking bar 240 and begins to rotate said locking bar 240 until the locking bar key 244 is removed from the safety notch 264 (FIG. 10), freeing the cylinder 260 for rotation (FIG. 10).

Figure 11:
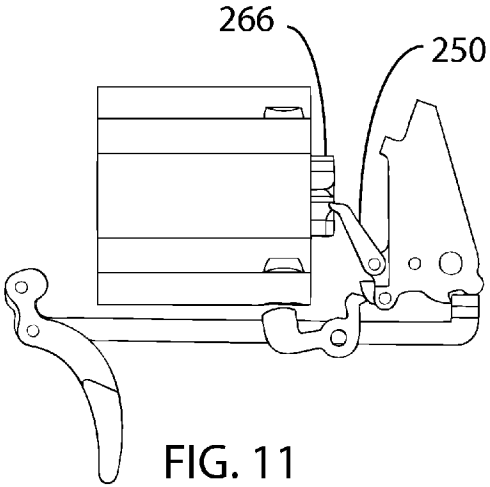
FIG. 11 is a side elevation view of the mechanism utilized in the revolver of FIG. 6, with the hand contacting the ratchet pads.
Figure 12:
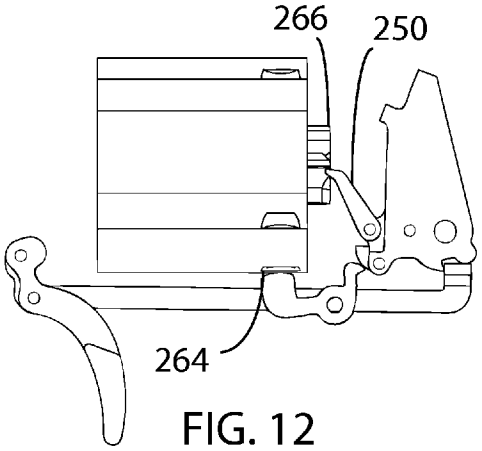
FIG. 12 is a side elevation view of the mechanism utilized in the revolver of FIG. 6, with the hand rotating the cylinder safety lock groove past the locking bar key.
Figure 13:
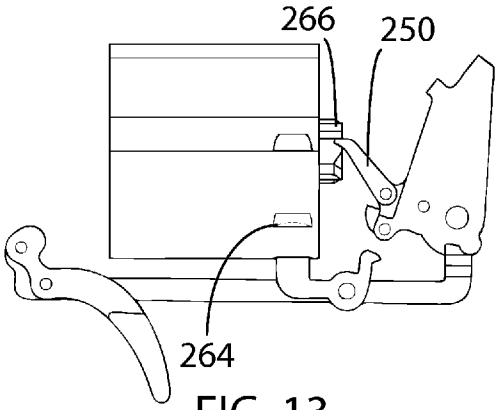
FIG. 13 is a side elevation view of the mechanism utilized in the revolver of FIG. 6, fully cocked.

The cylinder 260 is rotated by a ratcheting mechanism. The ratchet arm 250 is connected, ideally, to the hammer 230 and is moved into position as the hammer 230 is rotated backwards. After the cylinder 260 is free for rotation, and as the trigger pull progresses, ratchet arm 250 engages a ratchet pad 266 on the rear of the cylinder 260 (FIG. 11). At this time, the hammer pawl 232 is still engaged with the locking bar plate 242, keeping the locking bar 240 rotated and the locking bar key 244 away from the cylinder 260 so that it will not re-engage any safety notches 264 and still be able to rotate (FIG. 12). Eventually, as the trigger pull continues, the hammer 230 reaches a fully cocked stage (FIG. 13). The hammer pawl 232 has released the locking arm plate 242, and the locking bar key has engaged an active notch 262 in the circumference of the cylinder 260 which has been rotated into that position by the rising of the ratchet arm 250.

Figure 14:
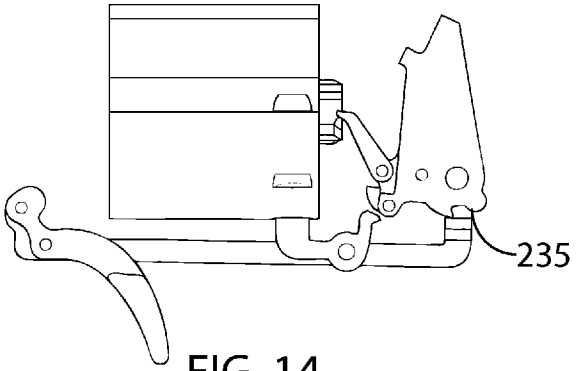
FIG. 14 is a side elevation view of the mechanism utilized in the revolver of FIG. 6, with hammer beginning to fall.
Figure 15:
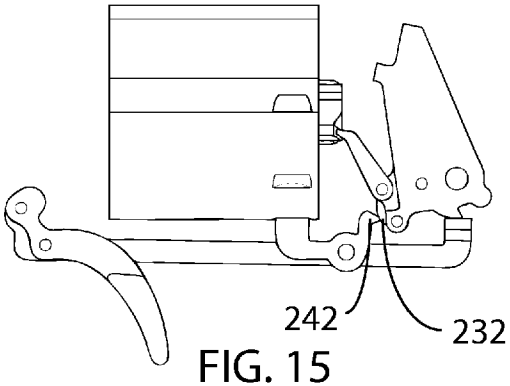
FIG. 15 is a side elevation view of the mechanism utilized in the revolver of FIG. 6, with the hammer pawl rotating against locking bar plate.
Figure 17:
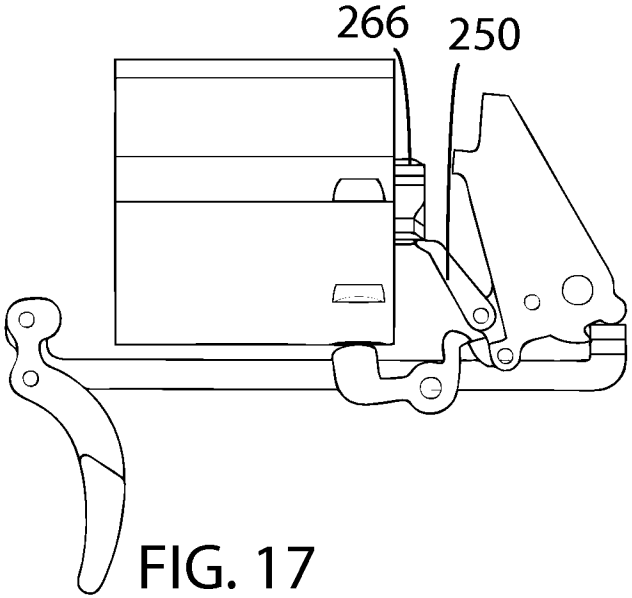
FIG. 17 is a side elevation view of the mechanism utilized in the revolver of FIG. 6, with the locking bar key again disengaged, preparing for a second firing.
Figure 16:
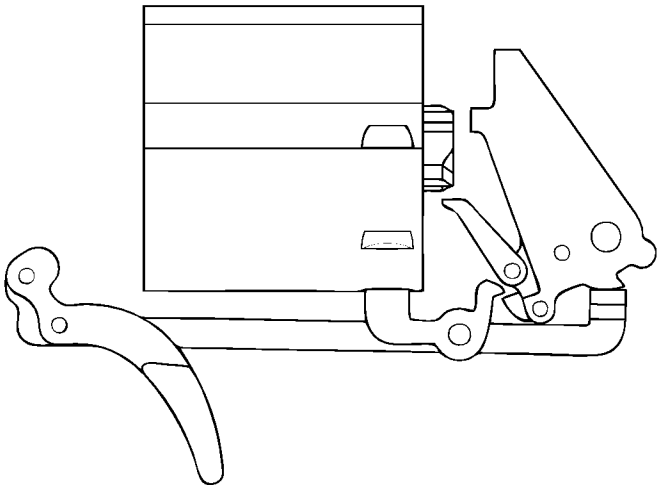
FIG. 16 is a side elevation view of the mechanism utilized in the revolver of FIG. 6, in a fired position, but with the trigger not reset.
Figure 18:
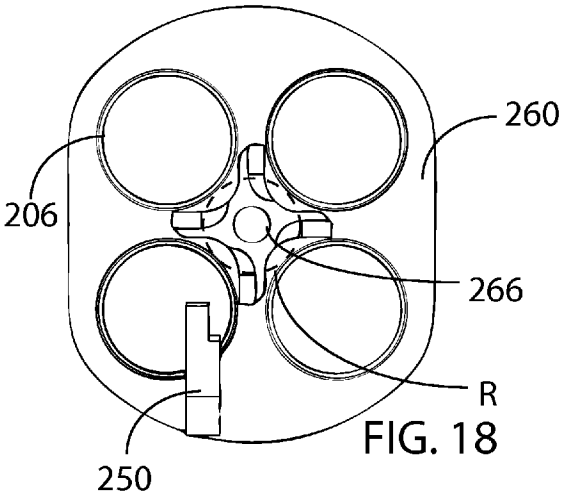
FIG. 18 is a rear elevation view of the cylinder and hand of the revolver of FIG. 6, in a stowed position, corresponding to FIG. 8.
Figure 19:
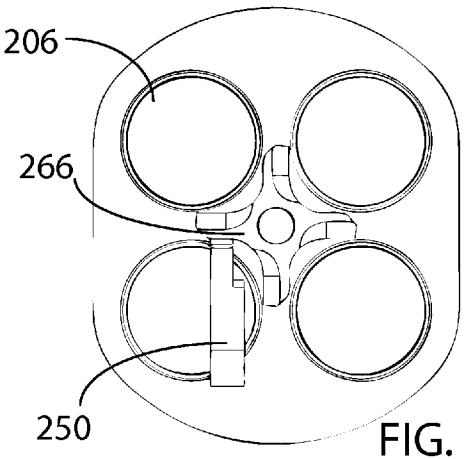
FIG. 19 is a rear elevation view of the cylinder and hand of the revolver of FIG. 6, in a stowed position, with the hand contacting the ratchet pads, corresponding to FIG. 11.
Figure 20:
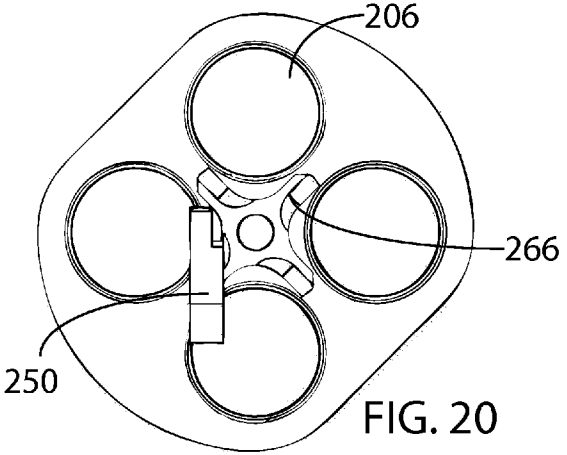
FIG. 20 is a rear elevation view of the cylinder and hand of the revolver of FIG. 6, fully cocked, corresponding to FIG. 13.
Figure 21:
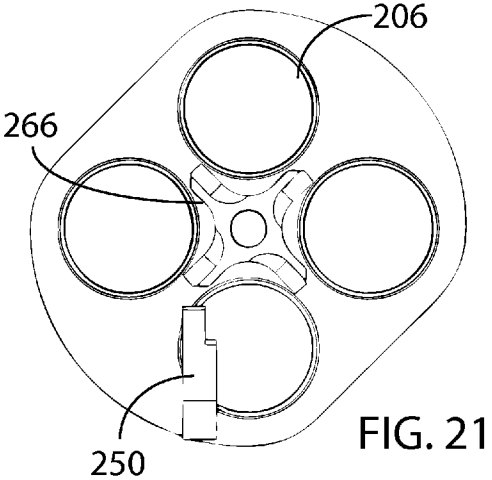
FIG. 21 is a rear elevation view of the cylinder and hand of the revolver of FIG. 6, in the fired position, corresponding to FIG. 16.
Figure 22:
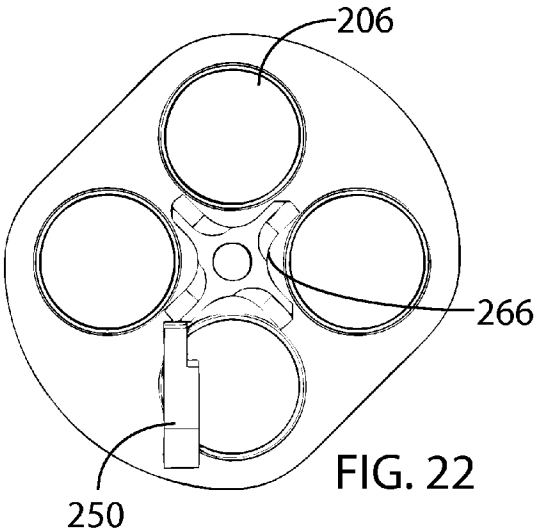
FIG. 22 is a rear elevation view of the cylinder and hand of the revolver of FIG. 6, in a fired position, with the hand contacting the ratchet pads, corresponding to FIG. 17.

When pulled sufficiently by the trigger, the drawbar 220 and the sear groove 235 will disconnect and release the hammer 230 (FIG. 14). As the hammer 230 falls, the hammer pawl 232 will again engage the locking bar plate 242, but will fold so as to pass by the plate (FIG. 15) and regain its initial position relative to the plate i.e. underneath the plate (FIG. 16). When firing has been completed (FIG. 16) the hammer pawl 232 and ratchet arm 250 have returned to their original position, but cylinder 260 is set with an ideally no longer loaded chamber 206 under the hammer 230 (FIG. 17). This causes a slight change in the system for when the trigger 210 is released and the drawbar returned into engagement with the sear groove 235. However, whether starting in a "half" position, such as when stowed, or in a "full" position, such as after firing, the ratchet arm 250 starts beneath the ratchet pad 266 and pushes the cylinder 260 until the next chamber 206 is in position. The movement of the ratchet arm 250 and the corresponding position and movement of the cylinder 260 are best seen in FIGS. 18-22. A unique aspect of the ratchet arm 250 is that it is unsupported by the ratchet pads 266 and, initially, starts over a chamber 206 (FIG. 18). After the system is then reset for firing a second time, with the cylinder 260 no longer in the stowed position, the ratchet arm 250 does make contact with the ratchet pad 266 (FIG. 22). Since the ratchet arm 250 makes contact with the ratchet pad 266 at this stage, it is important that the locking bar key 244 be clear of any active locking notch 262. Otherwise, the ratchet arm 250 may push the cylinder 260 before the locking bar key 244 is disengaged and the system will bind. Care must also be taken that the ratchet arm 250 does not interfere with the ratchet pad 266 as the ratchet arm 250 pushes the cylinder 260 into an operable position as it will pass over the next arm of the ratchet pad 266 (FIG. 20) as it advances and will pass over the ratchet pad again as it returns to position (FIG. 21). Ratchet pad 266 is ideally four arms positioned at 90° increments around the cylinder 260 (FIG. 18). The arms are thin and pass between the chambers 206 in the cylinder and do not impinge on them, or otherwise cover the chamber and any associated ammunition, in any way. The arms do cross the circumference of a circle R, the inner circle of two that are tangent to all four cylinders, as they must extend sufficiently to interact with the ratchet arm 250 when the cylinder has a chamber in the firing position and the ratchet arm 250 has returned to its original position. This angle would be about 45° offset from the original safety position of the cylinder 260.

Figure 23:
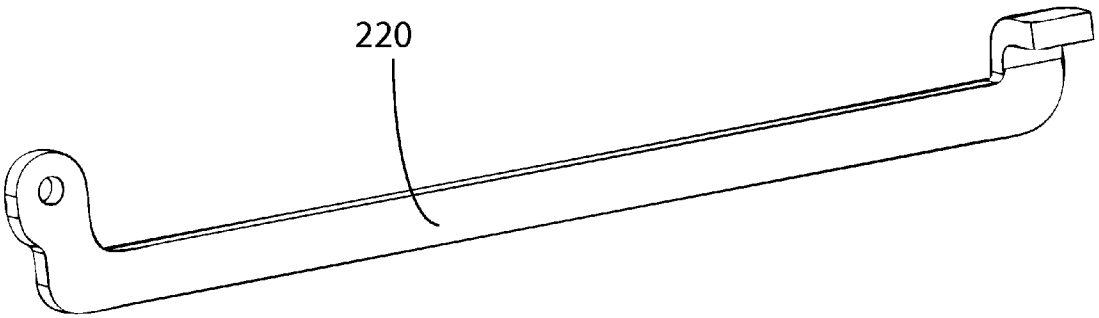
FIG. 23 is a perspective view of the drawbar used in the revolver of FIG. 6.

Another feature of the firearm is the stepped shape of the drawbar 220 (FIG. 23). The stepped shape (one step down, one step up) allows for clearance for other components of the mechanism, thus giving them room to move and perform their functions. The stepped design allows for a low bore height (relative to the user's hand) in the overall firearm design, which diminishes the occurrence of muzzle rise when firing. Ideally, though not necessarily, the step down and step up should approximate one another so that the drawbar steps down to a second "level" and returns to the original "level" when it steps up.

Figure 24:
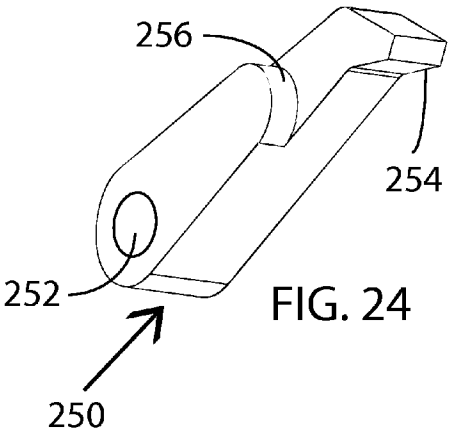
FIG. 24 is a perspective view of the ratchet arm used in the revolver of FIG. 6.
Figure 26:
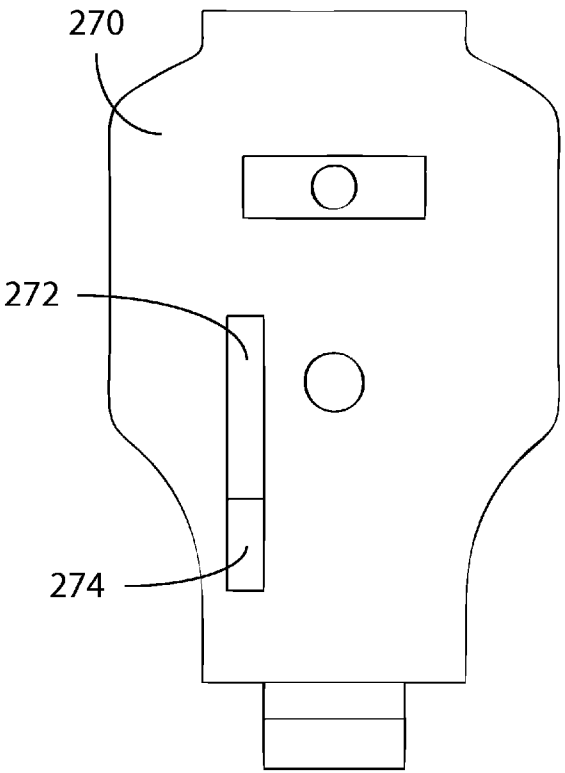
FIG. 26 is a rear elevation view of the breech plate of the revolver of FIG. 6
Figure 25:
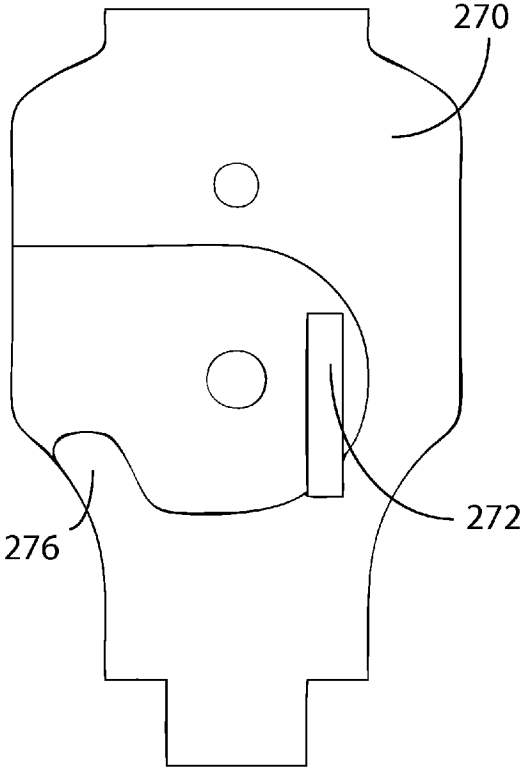
FIG. 25 is a front elevation view of the breech plate of the revolver of FIG. 6.
Figure 27:
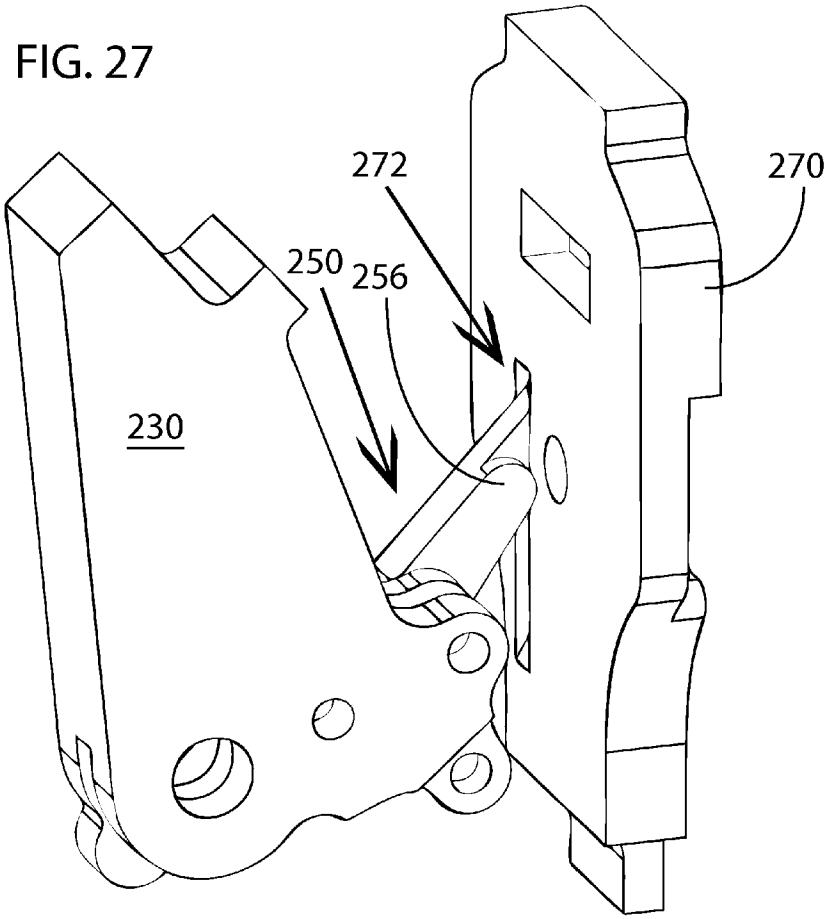
FIG. 27 is a rear perspective view of the hammer, ratchet arm and breach plate of the revolver of FIG. 6.

The ratchet arm 250 is a simple construction (FIG. 24). It features a pivot bore at its base 252 and a hand 254 protruding outward at its top. It also features a shoulder 256. Since the ratchet arm 250 has little support in the system from the ratchet pad 266 and must freely move, the ratchet arm 250 is mostly supported, in an ideal embodiment, by the breach plate 270 (FIGS. 25 and 26). A slot 272 is provided in one side of the breach plate 270 through which the ratchet arm 250 projects. A slight trench 274 is provided on the rear side for clearance and support of the ratchet arm 250. Since the ratchet arm 250 has limited support in the direction of the cylinder 260 axis, means need to be provided to limit penetration significantly beyond the breach plate 270. Otherwise, the ratchet arm 250 may bind the system by over-engaging the cylinder or cartridges it contains. Shoulder 256 is too wide to fit through slot 272 and therefore prevents the ratchet arm 250 from protruding through the breach plate 270 too far and interfering with the cylinder 260 or cartridges. The interaction of the ratchet arm 250 and breach plate 270 is best seen in FIG. 27, where the ratchet arm 250 is shown to bear on the breach plate 270 and interface the slot 272 so that it may then interact with the ratchet pad 266. Shoulder 256 is clearly seen to be preventing ratchet arm 250 from falling through the slot 272.

Figure 29:
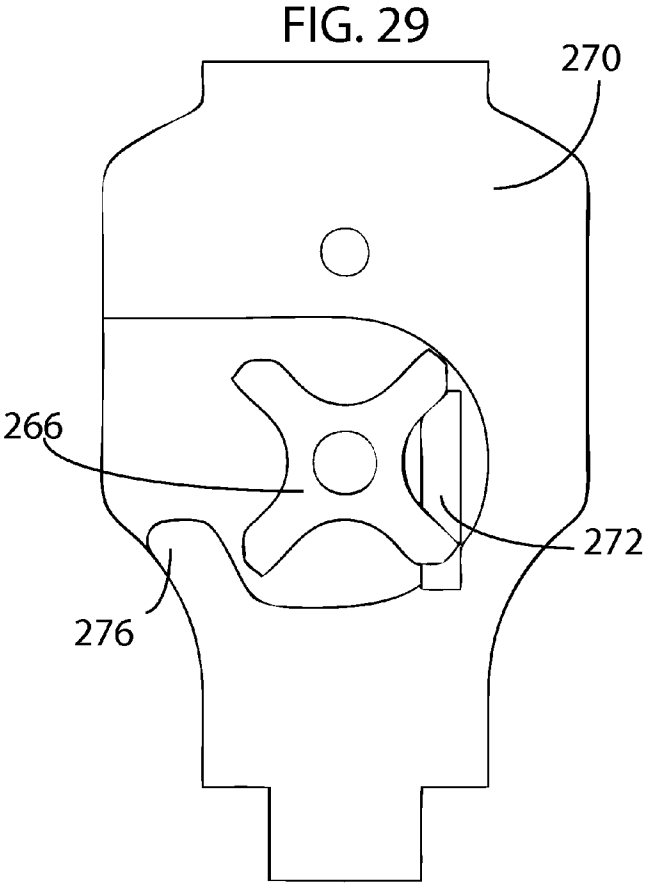
FIG. 29 is a partial sectional view of the breech plate and ratchet pads of the revolver of FIG. 6, in a fired position.
Figure 28:
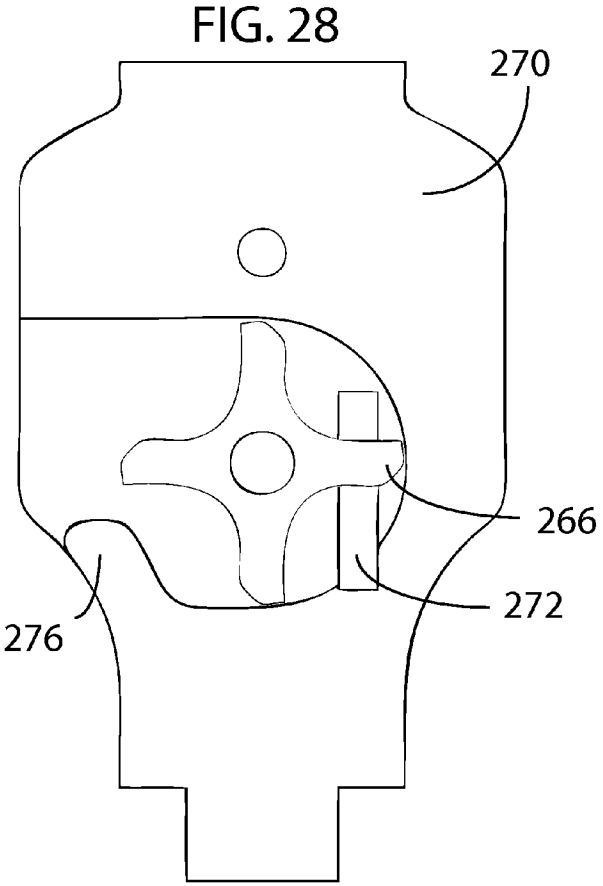
FIG. 28 is a partial sectional view of the breech plate and ratchet pads of the revolver of FIG. 6, in a stowed position.
Figure 31:
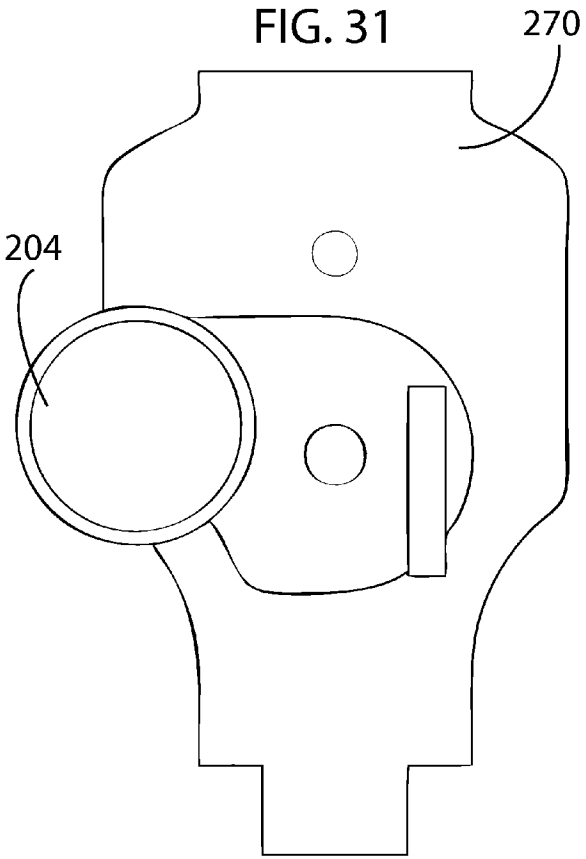
FIG. 31 is a partial sectional view of the breech plate and a cartridge for the revolver of FIG. 6, showing the ability of the breach plate to support the cartridge.
Figure 30:
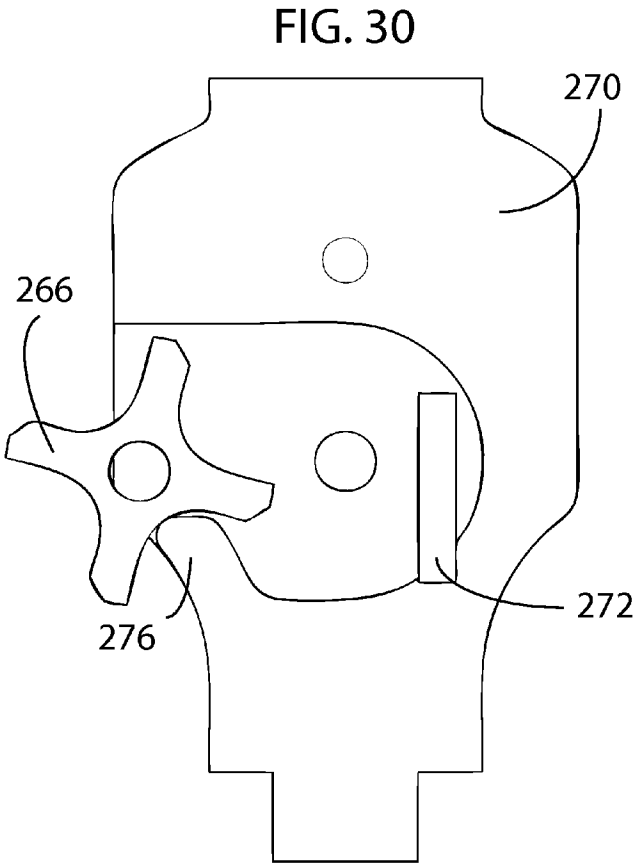
FIG. 30 is a partial sectional view of the breech plate and ratchet pads of the revolver of FIG. 6, as the cylinder is removed from the revolver.
Figure 33:
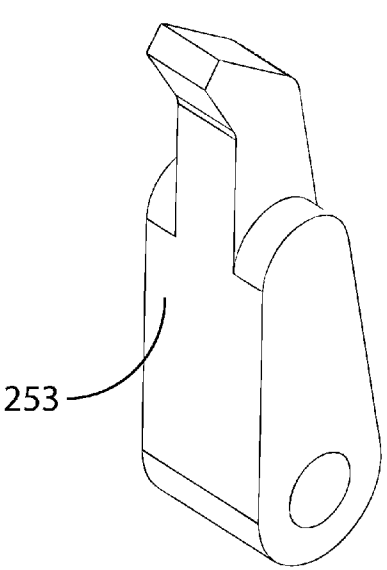
FIG. 33 is a perspective view of a third embodiment of a ratchet arm of FIG. 24.
Figure 34:
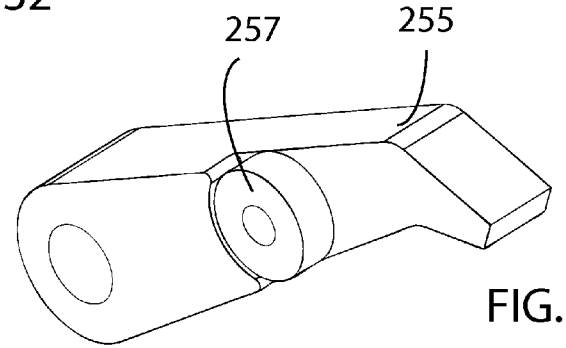
FIG. 34 is a perspective view of a forth embodiment of a ratchet arm of FIG. 24.

The breach plate 270 also provides securement for the cylinder. As can be seen in FIG. 25, the front face of the breach place is hollowed. This hollow accommodates the ratchet pads 266 as the cylinder rotates between its various positions, whether stowed (FIG. 28) or active (FIG. 29). As can be seen in FIGS. 28 and 29, arms of the ratchet pad 266 extend over the slot 272 regardless of position. A spur 276 is provided adjacent this hollow. In order to remove the cylinder 260, it is released and then rotated out of the breach plate 270, as shown in FIG. 30, with arms of the ratchet pad 266 fitting around the spur 276. A cartridge 204 is positioned next to the breach plate 270 and its opening in FIG. 31. At no time would a cartridge 204 be in a position that is not supported by the breach plate 270 in its travel in the cylinder 260, so a cartridge 204 will not be able to slip rearward into the breach plate hollow.

Figure 32:
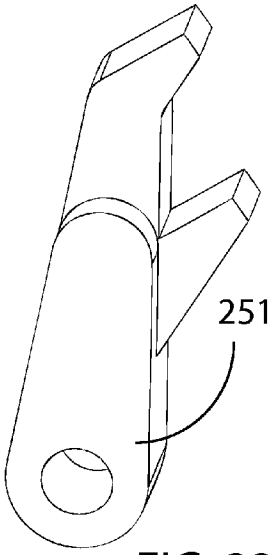
FIG. 32 is a perspective view of a second embodiment of a ratchet arm of FIG. 24.
Figure 35:
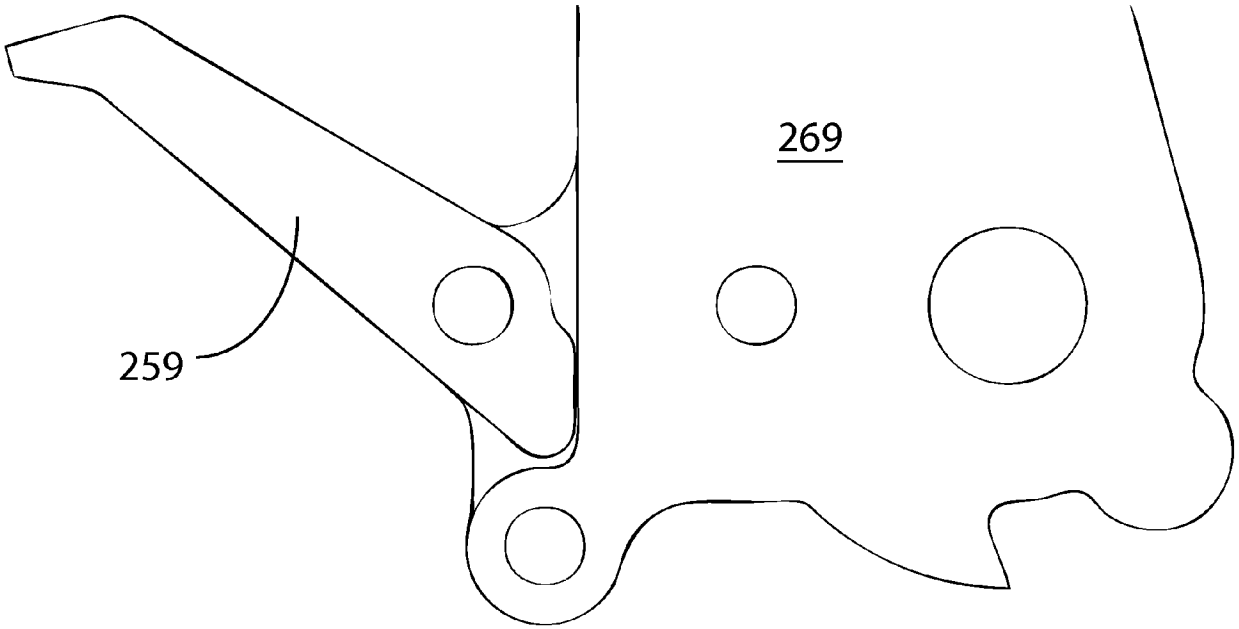
FIG. 35 is a rear elevation view of a fifth embodiment of a ratchet arm connected to an alternate embodiment of a hammer for the revolver of FIG. 6.

Alternate ratchet arm designs are also possible (FIGS. 32-35). In FIG. 32, the ratchet arm 251 uses a two-staged hand and shoulder to limit depth while ratchet arm 253 (FIG. 33) utilizes a second shoulder. Ratchet arm 255 (FIG. 34) reduces sliding friction by utilizing a roller 257 instead of a static shoulder. The ratchet arm embodiment 259 in FIG. 35 is hingedly connected to the hammer 269 and interaction with the hammer 269 is then used to limit depth of the ratchet arm 259.

Figure 37:
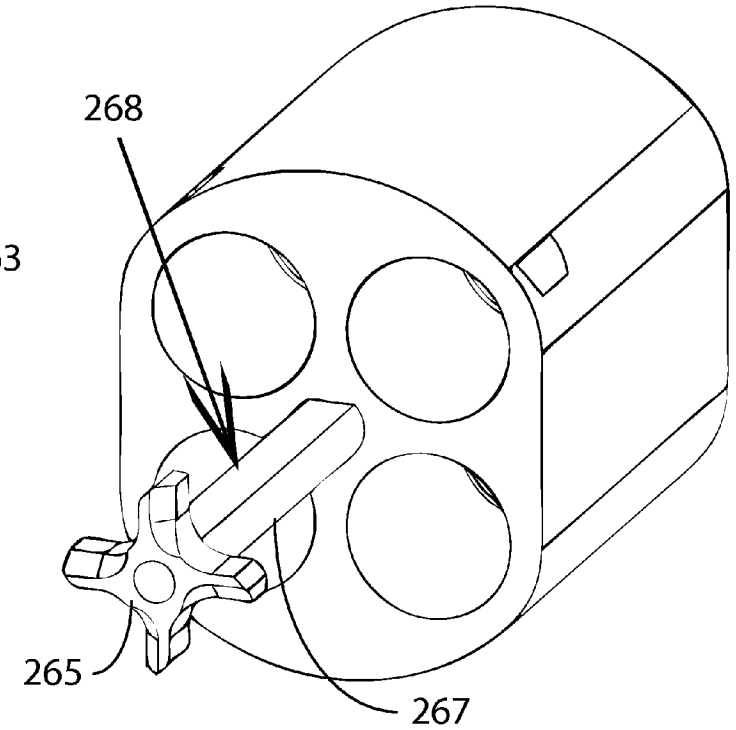
FIG. 37 is a perspective view of an alternative embodiment of ratchet pads of revolver of FIG. 6.
Figure 36:
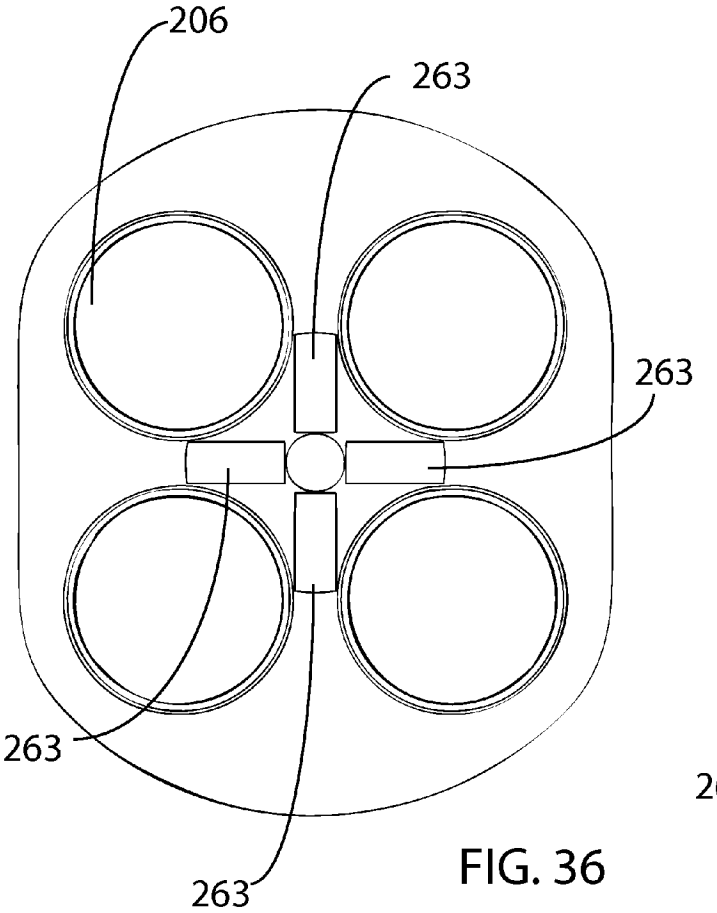
FIG. 36 is a rear elevation view of an alternative embodiment of ratchet pads of revolver of FIG. 6.

Likewise, alternate constructions of the ratchet pads are also possible. FIG. 36 depicts segmented, individual ratchet pads 263 for each chamber 206 while FIG. 37 depicts a removable ratchet pad 265, mounted upon a shaft 267 that slides within the cylinder 260. The shaft 267 may be rotationally secured against the cylinder by either the use of pins (not shown) or by a keying structure such as the flat 268 shown in the figure, either of which is well known in the art.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A revolver comprising:

a. a barrel, a cylinder, a trigger, a hammer, and a grip;

b. a drawbar connecting the hammer and trigger, the drawbar having two ends and being stepped in construction;

c. a breech plate, situated between the cylinder and hammer, said breech plate having a vertical slot;

d. a ratchet arm in communication with the hammer and extending through the slot in the breech plate;

e. at least one ratchet pad, located on a rear portion of the cylinder, proximate the breech plate; and f. the ratchet arm and at least one ratchet pad being capable of interface in which to rotate the cylinder;

wherein, the cylinder has a safety position relative to the revolver such that no chamber of the cylinder is aligned with the hammer and so that the ratchet arm does not engage the at least one ratchet pad when the cylinder is in said safety position.

2. A revolver comprising:

a. a barrel, a cylinder, a trigger, a hammer, and a grip;

b. a drawbar connecting the hammer and trigger, the drawbar having two ends and being stepped in construction;

c. a breech plate, situated between the cylinder and hammer, said breech plate having a vertical slot;

d. a ratchet arm in communication with the hammer and extending through the slot in the breech plate;

e. at least one ratchet pad, located on a rear portion of the cylinder, proximate the breech plate; and f. the ratchet arm and at least one ratchet pad being capable of interface in which to rotate the cylinder;

wherein, the ratchet arm is blocked by the breech plate so that said ratchet arm is limited in depth of penetration so that it does not over-engage the cylinder and cause binding of the system.

3. The revolver of claim 2, the ratchet arm further comprising a shoulder, interaction between the shoulder and breech plate limiting depth of penetration.

4. The revolver of claim 3, the ratchet arm further comprising a roller as at least a portion of the shoulder.

5. The revolver of claim 2, the ratchet arm further comprising at least two hands.

6. The revolver of claim 2, the ratchet arm being linked to the hammer in a manner to limit depth of penetration.

7. A revolver comprising:

a. A barrel, a cylinder, a trigger, a hammer, and a grip;

b. A drawbar connecting the hammer and trigger, the drawbar having two ends and being stepped in construction;

c. a breech plate, situated between the cylinder and hammer, said breech plate having a vertical slot and further comprising a spur;

d. a ratchet arm in communication with the hammer and extending through the slot in the breech plate;

e. at least one ratchet pad, located on a rear portion of the cylinder, proximate the breech plate; and f. the ratchet arm and at least one ratchet pad being capable of interface in which to rotate the cylinder;

wherein, the spur is situated to allow the cylinder, and associated at least one ratchet pad, to be rotated out of engagement with the breach plate, while also preventing a cartridge contained in said cylinder from sliding rearwards into the breach plate.

8. A revolver comprising:

a. a barrel, a cylinder, a trigger, a hammer, and a grip;

b. a breech plate, situated between the cylinder and hammer, said breach plate having a vertical slot;

c. a ratchet arm in communication with the hammer and also extending through the slot in the breech plate;

d. at least one ratchet pad, located on a rear portion of the cylinder, proximate the breech plate;

e. the ratchet arm and at least one ratchet pad being capable of interface in which to rotate the cylinder;

wherein the ratchet arm is limited as it extends through the slot in the breech plate so as to prevent binding of the revolver and the cylinder has a safety position relative to the revolver such that no chamber of the cylinder is aligned with the hammer and so that the ratchet arm does not engage the at least one ratchet pad when the cylinder is in said safety position.

9. A revolver comprising:

a. a barrel, a cylinder, a trigger, a hammer, and a grip;

b. a breech plate, situated between the cylinder and hammer, said breech plate having a vertical slot;

c. a ratchet arm in communication with the hammer and also extending through the slot in the breech plate the ratchet arm being blocked by the breech plate as it extends through the slot in the breech plate so that said ratchet arm is limited in depth of penetration so that it does not over-engage the cylinder and cause binding of the system;

d. at least one ratchet pad, located on a rear portion of the cylinder, proximate the breech plate;

e. the ratchet arm and at least one ratchet pad being capable of interface in which to rotate the cylinder.

10. The revolver of claim 9, the ratchet arm further comprising a shoulder, interaction between the shoulder and breech plate limiting depth of penetration.

11. The revolver of claim 10, the ratchet arm further comprising a roller as at least a portion of the shoulder.

12. The revolver of claim 9, the ratchet arm further comprising at least two hands.

13. The revolver of claim 9, the ratchet arm being linked to the hammer in a manner to limit depth of penetration.

14. A revolver comprising:

a. a barrel, a cylinder, a trigger, a hammer, and a grip;

b. a breech plate, situated between the cylinder and hammer, said breech plate having a vertical slot the breach plate further comprising a spur;

c. a ratchet arm in communication with the hammer and also extending through the slot in the breach plate;

d. at least one ratchet pad, located on a rear portion of the cylinder, proximate the breach plate;

e. the ratchet arm and at least one ratchet pad being capable of interface in which to rotate the cylinder;

wherein the ratchet arm is limited as it extends through the slot in the breach plate so as to prevent binding of the revolver and the spur is situated to allow the cylinder, and associated at least one ratchet pad, to be rotated out of engagement with the breach plate, while also preventing a cartridge contained in said cylinder from sliding rearwards into the breach plate.

15. In a revolver cylinder a ratchet pad comprising four arms positioned at 90° increments about a circle and each arm having a length sufficient to cross a perimeter of a circle drawn tangent to chambers contained in the cylinder and narrow enough such that the arms do not impinge on the chambers.

16. A revolver comprising:

a. a barrel, a cylinder, a trigger, a hammer, and a grip;

b. a drawbar having two ends connecting the hammer and trigger, the drawbar being stepped in construction such that both of the two ends of the drawbar terminate at a point above a lower surface of the cylinder;

c. a breach plate, situated between the cylinder and hammer, said breach plate having a vertical slot;

d. a ratchet arm in communication with the hammer and extending through the slot in the breach plate;

e. at least one ratchet pad, located on a rear portion of the cylinder, proximate the breach plate;

f. the ratchet arm and at least one ratchet pad being capable of interface in which to rotate the cylinder.

17. The revolver of claim 16, the two ends of the drawbar connecting to the hammer and the trigger at a roughly equal distance from a line defined by a bore of the barrel.

* * * * *